US005850714A

United States Patent [19]

Liem

[11] Patent Number: 5,850,714

[45] Date of Patent: Dec. 22, 1998

[54] WALL CONSTRUCTION SYSTEM

[76] Inventor: Ken Liem, 6 Morgan S 100, Irvine, Calif. 92718

[21] Appl. No.: 870,038

[22] Filed: Jun. 5, 1997

[51] Int. Cl.[6] ..... E02D 27/00

[52] U.S. Cl. ..... 52/293.3; 52/376; 52/737.3

[58] Field of Search ..... 52/287.1, 293.3, 52/295, 698, 699, 274, 241, 376, 730.7, 737.3

[56] References Cited

U.S. PATENT DOCUMENTS

| | | | |
|---|---|---|---|
| 2,154,944 | 4/1939 | Kullmer | 52/376 |
| 2,178,388 | 10/1939 | Beckman | 59/737.3 X |
| 2,252,956 | 8/1941 | Aoler | 52/376 |
| 3,313,070 | 4/1967 | Elotson | 52/376 X |
| 4,856,250 | 8/1989 | Gronau et al. | 52/376 X |
| 5,307,600 | 5/1994 | Simon, Jr. et al. | 52/293.3 X |
| 5,687,529 | 11/1997 | Pickering | 52/698 X |

FOREIGN PATENT DOCUMENTS

| | | | |
|---|---|---|---|
| 7807084 | 1/1980 | Netherlands | 52/241 |

*Primary Examiner*—Creighton Smith

[57] ABSTRACT

A new Wall Construction System for providing a baseboard attachment system for masonry walls. The inventive device includes an elongated base member comprising an elongated bottom plate, an elongated setback sidewall extending upward from the elongated bottom plate, and an elongated top plate extending outward from the elongated setback sidewall. The elongated setback sidewall is orthogonally oriented relative to the elongated bottom plate and the elongated top plate whereby the elongated top plate parallels the elongated bottom plate in spaced relation. The elongated bottom plate, the elongated setback sidewall, and the elongated top plate form an elongated channel adapted for retaining an elongated wood member which defines a nailing strip for nailing of a molding thereto.

13 Claims, 5 Drawing Sheets

WALL CONSTRUCTION SYSTEM

BACKGROUND OF THE INVENTION

1. Field of the invention

The present invention relates to wall systems and more particularly pertains to a new Wall Construction System for providing a baseboard attachment system for masonry walls.

2. Description of the Prior Art

The use of wall systems is known in the prior art. More specifically, wall systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art wall systems include U.S. Pat. No. 5,351,455; U.S. Pat. No. 5,074,088; U.S. Pat. No. 5,433,043; U.S. Pat. No. 4,642,957; U.S. Pat. No. 5,080,321; and U.S. Pat. No. 4,059,939 .

While these devices fulfill their respective, particular objectives and requirements, the aforementioned patents do not disclose a new Wall Construction System. The inventive device includes an elongated base member comprising an elongated bottom plate, an elongated setback sidewall extending upward from the elongated bottom plate, and an elongated top plate extending outward from the elongated setback sidewall. The elongated setback sidewall is orthogonally oriented relative to the elongated bottom plate and the elongated top plate whereby the elongated top plate parallels the elongated bottom plate in spaced relation. The elongated bottom plate, the elongated setback sidewall, and the elongated top plate form an elongated channel adapted for retaining an elongated wood member which defines a nailing strip for nailing of a molding thereto.

In these respects, the Wall Construction System according to the present invention substantially departs from the conventional concepts and designs of the prior art, and in so doing provides an apparatus primarily developed for the purpose of providing a baseboard attachment system for masonry walls.

SUMMARY OF THE INVENTION

In view of the foregoing disadvantages inherent in the known types of wall systems now present in the prior art, the present invention provides a new Wall Construction System construction wherein the same can be utilized for providing a baseboard attachment system for masonry walls.

The general purpose of the present invention, which will be described subsequently in greater detail, is to provide a new Wall Construction System apparatus and method which has many of the advantages of the wall systems mentioned heretofore and many novel features that result in a new Wall Construction System which is not anticipated, rendered obvious, suggested, or even implied by any of the prior art wall systems, either alone or in any combination thereof.

To attain this, the present invention generally comprises an elongated base member comprising an elongated bottom plate, an elongated setback sidewall extending upward from the elongated bottom plate, and an elongated top plate extending outward from the elongated setback sidewall. The elongated setback sidewall is orthogonally oriented relative to the elongated bottom plate and the elongated top plate whereby the elongated top plate parallels the elongated bottom plate in spaced relation. The elongated bottom plate, the elongated setback sidewall, and the elongated top plate form an elongated channel adapted for retaining an elongated wood member which defines a nailing strip for nailing of a molding thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Wall Construction System apparatus and method which has many of the advantages of the wall systems mentioned heretofore and many novel features that result in a new Wall Construction System which is not anticipated, rendered obvious, suggested, or even implied by any of the prior art wall systems, either alone or in any combination thereof.

It is another object of the present invention to provide a new Wall Construction System which may be easily and efficiently manufactured and marketed.

It is a further object of the present invention to provide a new Wall Construction System which is of a durable and reliable construction.

An even further object of the present invention is to provide a new Wall Construction System which is susceptible of a low cost of manufacture with regard to both materials and labor, and which accordingly is then susceptible of low prices of sale to the consuming public, thereby making such Wall Construction System economically available to the buying public.

Still yet another object of the present invention is to provide a new Wall Construction System which provides in the apparatuses and methods of the prior art some of the advantages thereof, while simultaneously overcoming some of the disadvantages normally associated therewith.

Still another object of the present invention is to provide a new Wall Construction System for providing a baseboard attachment system for masonry walls.

Yet another object of the present invention is to provide a new Wall Construction System which includes an elongated base member comprising an elongated bottom plate, an elongated setback sidewall extending upward from the elongated bottom plate, and an elongated top plate extending outward from the elongated setback sidewall. The elongated setback sidewall is orthogonally oriented relative to the elongated bottom plate and the elongated top plate whereby the elongated top plate parallels the elongated bottom plate in spaced relation. The elongated bottom plate, the elongated setback sidewall, and the elongated top plate form an elongated channel adapted for retaining an elongated wood member which defines a nailing strip for nailing of a molding thereto.

Still yet another object of the present invention is to provide a new Wall Construction System that eases the installation and improves the quality of wood trim applications on masonry walls. Traditionally, attachment of wood trim to masonry walls required the use of large nails or screws that had to be driven through the wood trim and into the masonry wall. This method was labor intensive and diminished the finished quality of the masonry wall. Accordingly, it is an object of the present invention to facilitate and improve the quality of wood trim applications on masonry walls.

Even still another object of the present invention is to provide a new Wall Construction System that can be used as a guide for the even application of plaster (i.e., a screed). As such, accurate and better quality walls can be formed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
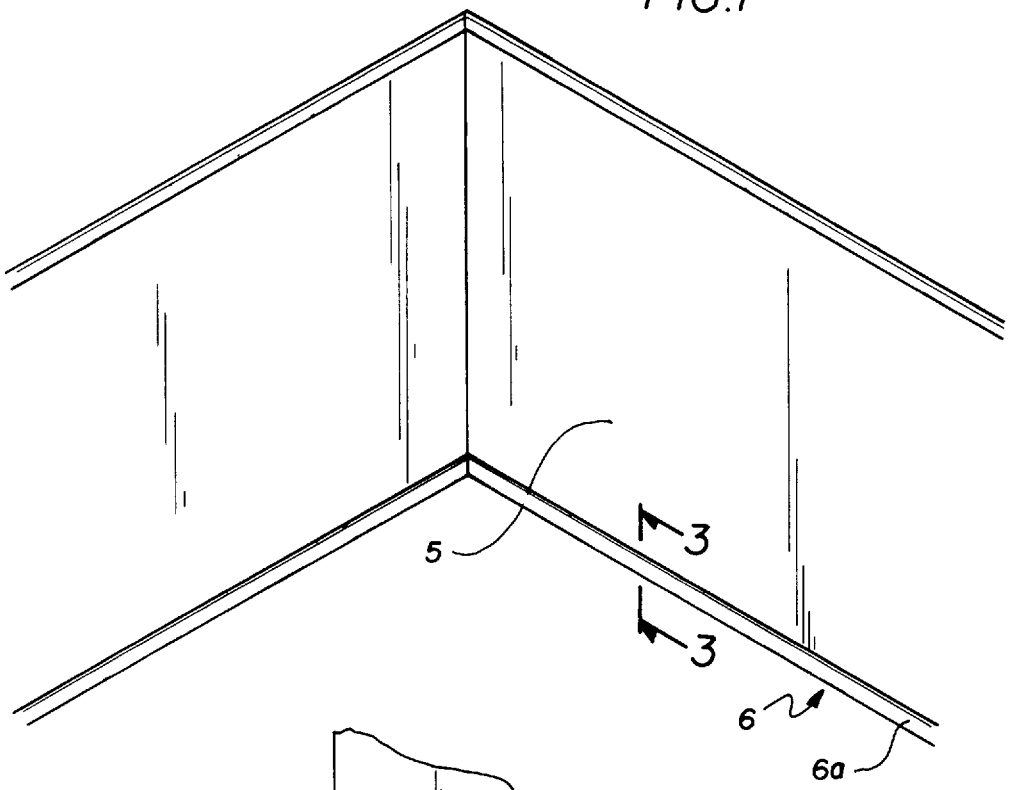
FIG. 1 is an illustration of a new Wall Construction System according to the present invention.
Figure 2:
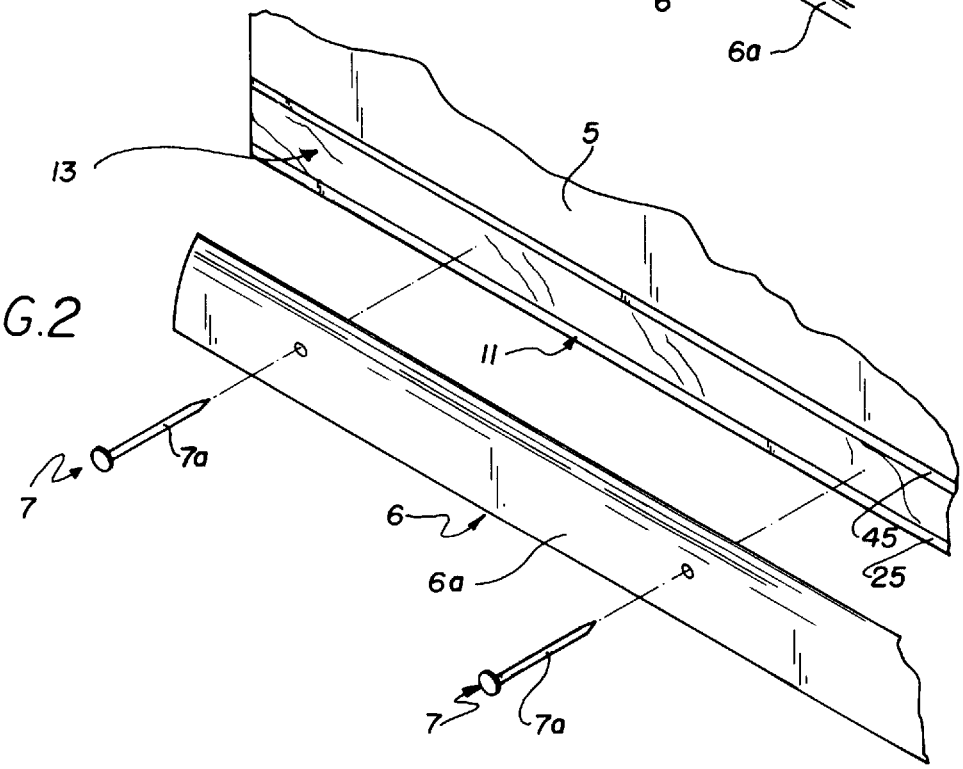
FIG. 2 is an illustration of the installation of a baseboard according to the present invention.
Figure 3:
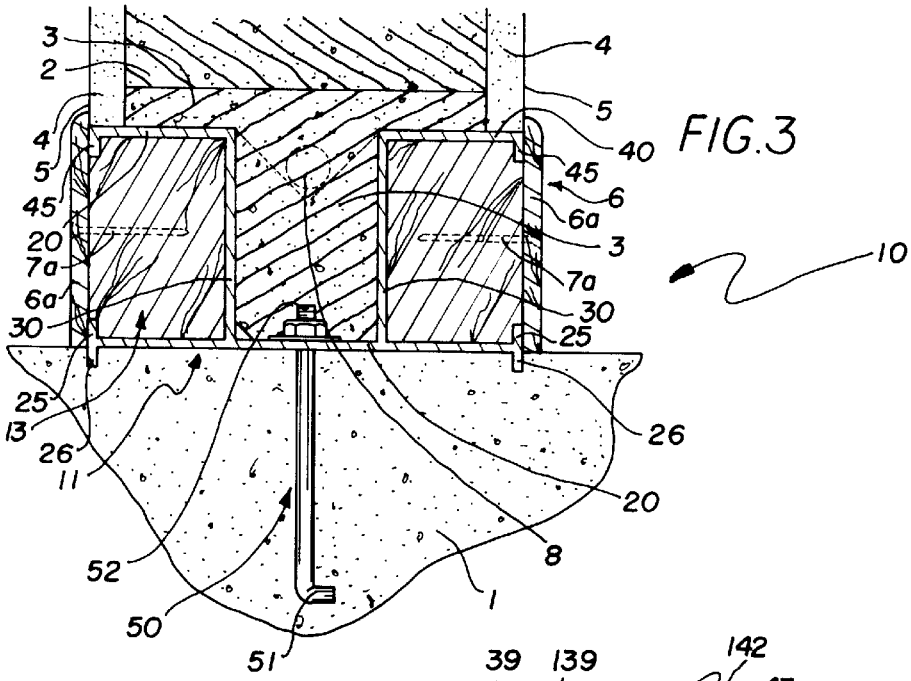
FIG. 3 is a cross sectional view taken along line 3—3 of FIG. 1.
Figure 4:
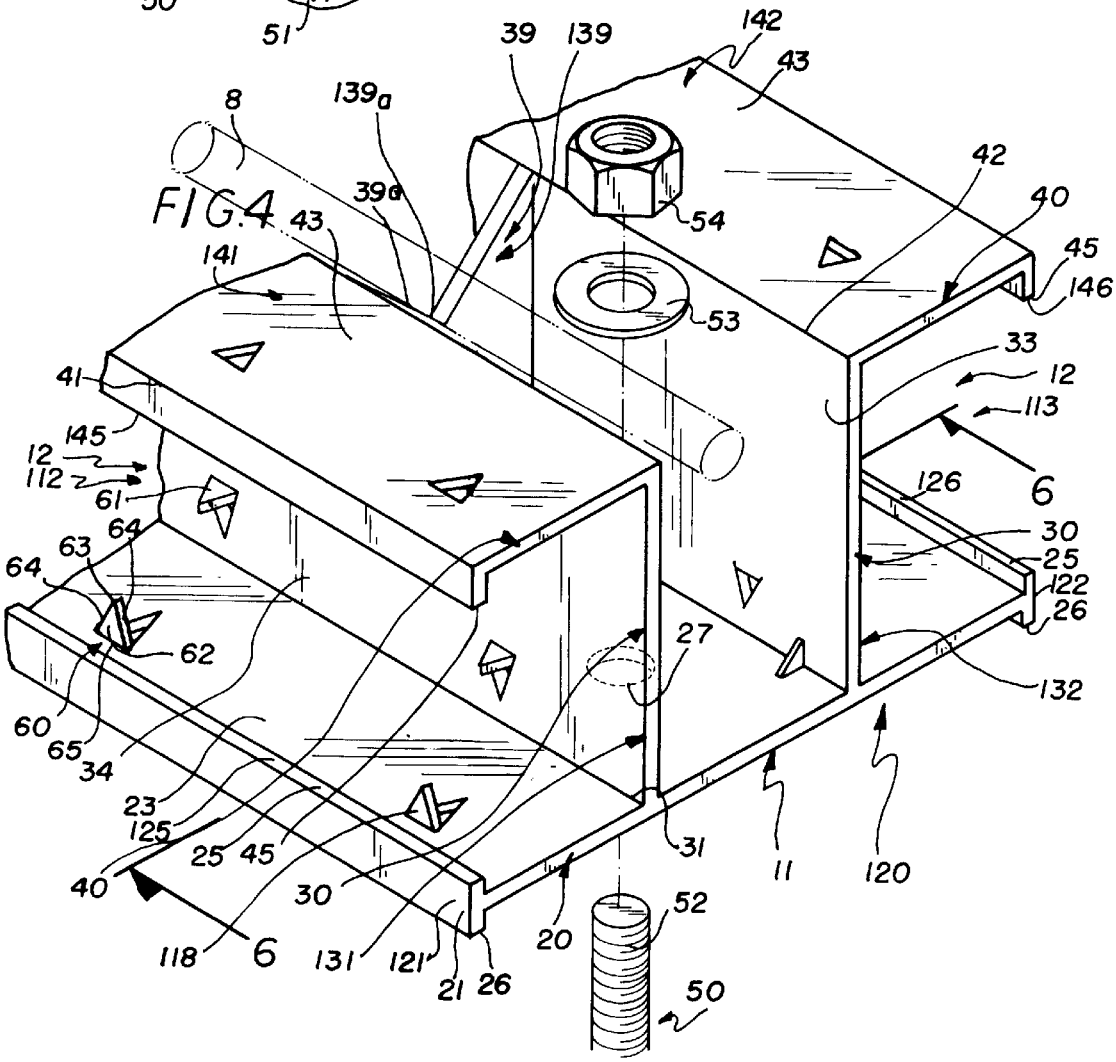
FIG. 4 is a top isometric view of a first embodiment of the present invention.
Figure 5:
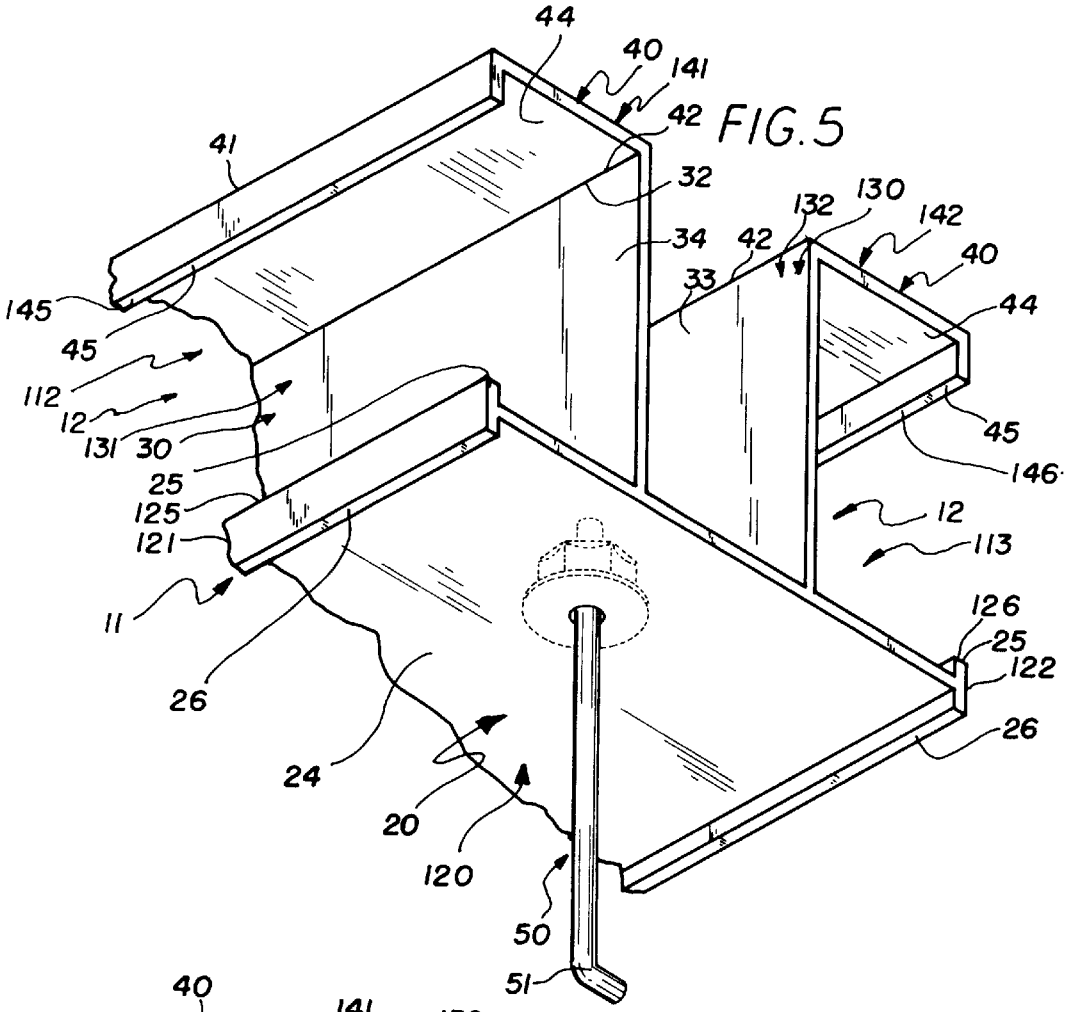
FIG. 5 is a bottom isometric view of the first embodiment of the present invention.
Figure 6:
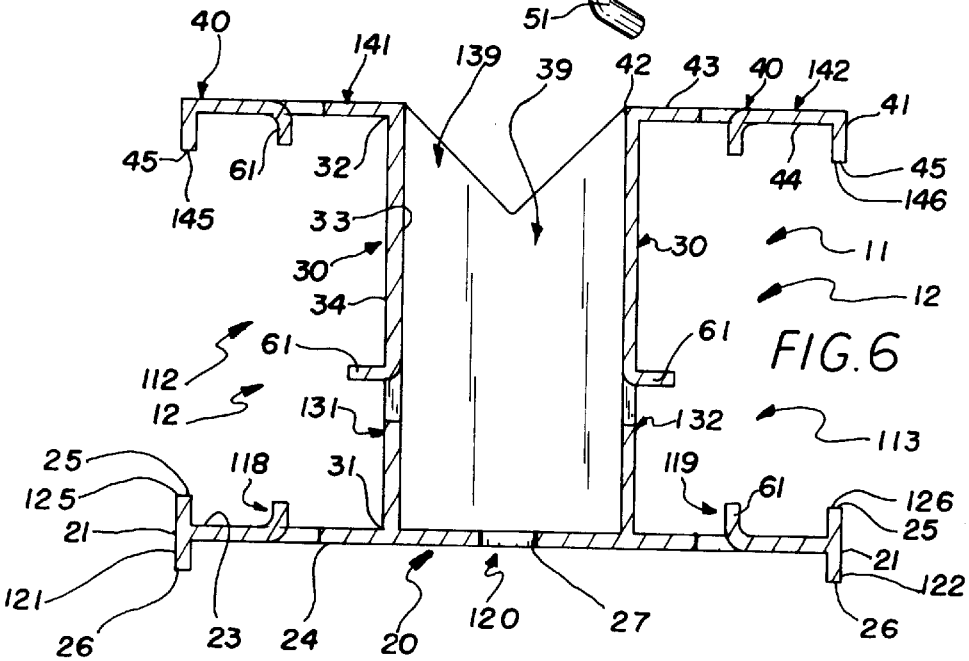
FIG. 6 is a cross sectional view taken along line 6—6 of FIG. 4.

With reference now to the drawings, and in particular to FIGS. 1 through 10 thereof, a new Wall Construction System embodying the principles and concepts of the present invention and generally designated by the reference numeral 10 will be described.

More specifically, it will be noted that the Wall Construction System 10 comprises an elongated base member 11 comprising an elongated bottom plate 20, an elongated setback sidewall 30 extending upward from the elongated bottom plate 20, and an elongated top plate 40 extending outward from the elongated setback sidewall 30. The elongated setback sidewall 30 is orthogonally oriented relative to the elongated bottom plate 20 and the elongated top plate 40 whereby the elongated top plate 40 parallels the elongated bottom plate 20 in spaced relation. The elongated bottom plate 20, the elongated setback sidewall 30, and the elongated top plate 40 form an elongated channel 12 adapted for retaining an elongated wood member 13 which defines a nailing strip for nailing of a molding 5 thereto.

The present invention is intended for use in masonry wall construction wherein layers of brick 2 are vertically stacked upon a bed of mortar 3 to create a masonry wall and a layer of plaster 4 is applied to the sides of the stacked bricks to create a finished wall surface 5. The molding 6, more specifically a baseboard 6*a*, is secured to the elongated wood member 13 by a fastener 7, such as a nail 7*a*. Although the present invention is intended for use in securing a baseboard 6*a* along a masonry wall, principles of the present invention are applicable also to other molding applications such as crown-molding, window trim, and door trim.

As best illustrated in FIGS. 3 through 6, it can be shown that the elongated bottom plate 20 has a side edge 21, an upper surface 23, and a lower surface 24. A lower lip 25 is provided along the side edge 21 of the elongated bottom plate 20 and perpendicularly extends upward from the upper surface 23 of the elongated bottom plate 20. A foot 26 is provided along the side edge 21 of the elongated bottom plate 20 and perpendicularly extends downward from the lower surface 24 of the elongated bottom plate 20. In use, the foot 26 is embedded in the underlying surface, and more specifically a bed of mortar 3. In an illustrative embodiment, the elongated bottom plate 20 is 6inches (15 cm) wide. The width of the elongated bottom plate 20 may vary according to the thickness of the wall being constructed.

A hole 27 is provided in the elongated bottom plate 20 for receiving an anchor bolt 50 for anchoring the elongated base member 11 to an underlying surface, such as a footing 1. The anchor bolt 50 has a first end 51 inserted into the footing 1 and a second threaded end 52 extending above the footing 1 for insertion through the hole 27 in the elongated bottom plate 20 and for receiving a washer 53 and a threaded nut 54. In an illustrative embodiment, a hole 27 is provided in the elongated bottom plate 20 approximately every 12inches.

The elongated setback sidewall 30 has a bottom edge 31, a top edge 32, an innermost surface 33, and an outermost surface 34. The elongated setback sidewall 30 is joined to the elongated bottom plate 20 along the bottom edge 31 of the elongated setback sidewall 30. The elongated setback sidewall 30 perpendicularly extends upward from the upper surface 23 of the elongated bottom plate 20 and is setback from the side edge 21 of the elongated bottom plate 20.

The elongated top plate 40 has an outer edge 41, an inner edge 42, an upper surface 43, and a lower surface 44. The elongated top plate 40 and the elongated setback sidewall 30 are joined along the inner edge 42 of the elongated top plate 40 and the top edge 32 of the elongated setback sidewall 30. The elongated top plate 40 perpendicularly extends outward from the elongated setback sidewall 30. As such, the elongated top plate 40 parallels the elongated bottom plate 20 in spaced relation. An upper lip 45 is provided along the outer edge 41 of the elongated top plate 40 and perpendicularly extends downward from the lower surface 44 of the elongated top plate 40.

A vertical plate 39 is perpendicularly joined to the innermost surface 33 of the elongated setback sidewall 30 and the upper surface 23 of the elongated bottom plate 20. The vertical plate 39 includes a notched portion 39*a* The notched portion 39*a* is generally V-shaped. In an illustrative embodiment, a vertical plate 39 is provided approximately every 12inches. The elongated bottom plate 20, the elongated setback sidewall 30, and two spaced vertical plates 39 define a cavity for receiving mortar 3 during construction of the wall. The notched portion 39*a* allows mortar 3 in adjacent cavities to bond together, thereby forming a continuous bond beam of mortar 3. Additionally, a reinforcement bar 8 may be positioned so as to traverse the notched portions 39*a* of spaced vertical plates 39 prior to the addition of mortar 3. As such, the reinforcement bar 8 reinforces the continuous bond beam of mortar 3.

Figure 7:
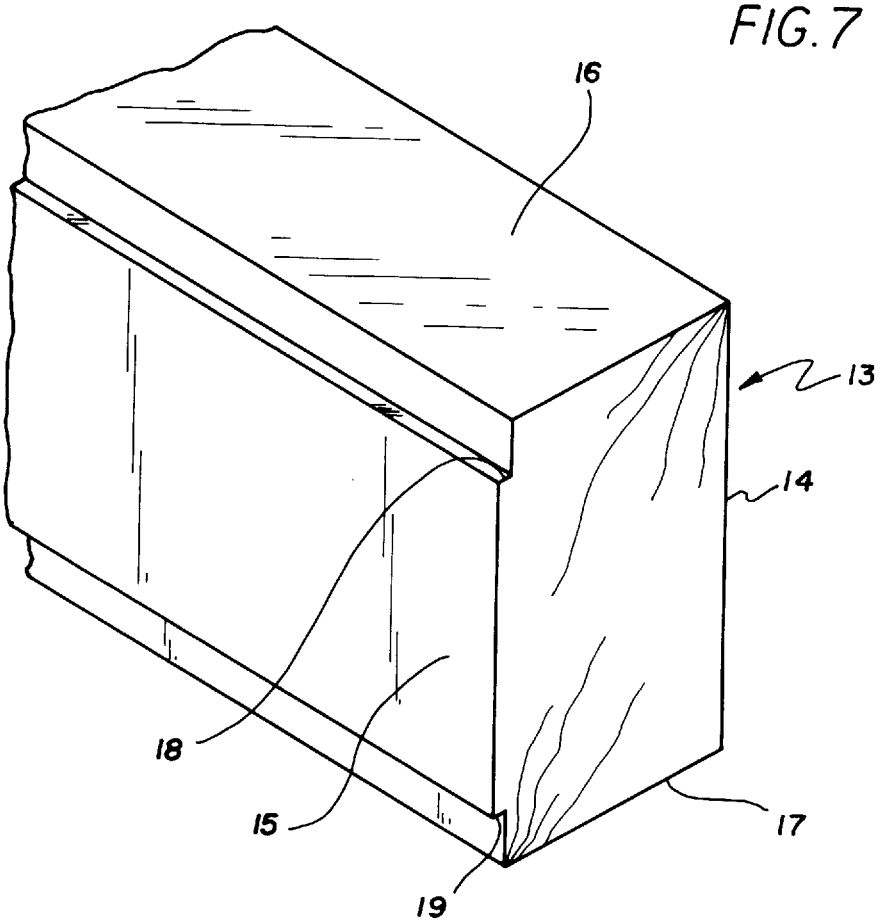
FIG. 7 is a top isometric view of the elongated wood member of the present invention.
Figure 8:
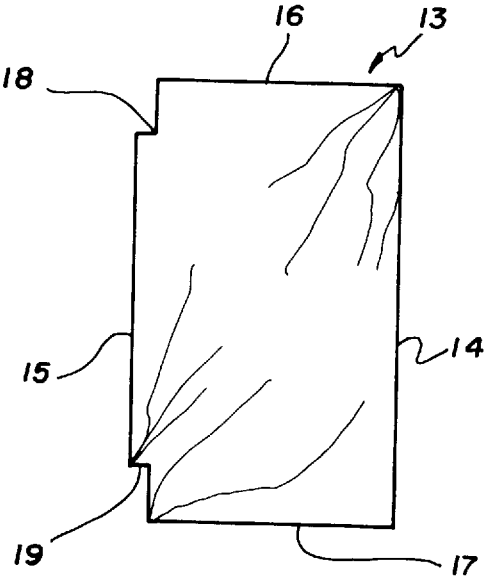
FIG. 8 is an end view of the elongated wood member of the present invention.

As best illustrated in FIGS. 7 and 8, it can be shown that the elongated wood member 13 has inner face 14, an outer face 15, a top face 16, and a bottom face 17. The outer face 15 has an upper groove 18 and a lower groove 19 therein adjacent the top face 16 and the bottom face 17, respectively, of the elongated wood member 13. The elongated wood member 13 is fitted within the elongated channel 12 such that the inner face 14 abuts the outermost surface 34 of the elongated setback sidewall 30, such that the top face 16 abuts the lower surface 44 of the elongated top plate 40, and such that the bottom face 17 abuts the upper surface 23 of the elongated bottom plate 20. The lower lip 25 fits within the lower groove 19 provided in the outer face 15 and the upper lip 45 fits within the upper groove 18 provided in the outer face 15.

A wood member retaining means 60 is provided for retaining the elongated wood member 13 within the elongated channel 12. The wood member retaining means 60 comprises a plurality of teeth 61 protruding into the elongated channel 12 and into the elongated wood member 13 from at least one of the upper surface 23 of the elongated bottom plate 20, the outermost surface 34 of the elongated setback sidewall 30, and the lower surface 44 of the elongated top plate 40. Each of the plurality of teeth 61 is formed by making a V-shaped cut in the elongated bottom plate 20, the elongated setback sidewall 30, or the elongated top plate 40 so as to form a triangular-shaped portion 62 having a free vertex 63, two free sides 64 adjacent the free vertex 63, and an attached side 65 opposite the free vertex 63.

With the elongated wood member 13 fitted within the elongated channel 12, the free vertex 63 of the triangular-shaped portion 62 is bent towards the elongated wood member 13 so as to create one of the plurality of teeth 61. Collectively, when bent into the elongated channel 12, the plurality of teeth 61 force the elongated wood member 13 generally outward against the lower lip 25 of the elongated bottom plate 20 and against the upper lip 45 of the elongated top plate 40. The wood member retaining means 60 may also comprise a plurality of fasteners (not shown) driven into the elongated wood member 13 through at least one of the elongated bottom plate 20, the elongated setback sidewall 30, and the elongated top plate 40.

As best illustrated in FIGS. 3 through 6, it can be shown that a first embodiment of the present invention is intended for use in interior wall construction wherein the elongated bottom plate 120 has a first side edge 121 and a second side edge 122. A first elongated setback sidewall 131 extends upward from the elongated bottom plate 120 and is setback from the first side edge 121 thereof and a second elongated setback sidewall 132 extends upward from the elongated bottom plate 120 and is setback from the second side edge 122 thereof. A first elongated top plate 141 extends outward from the first elongated setback sidewall 131 and a second elongated top plate 142 extends outward from the second elongated setback sidewall 132. As such, the elongated bottom plate 120, the first elongated setback sidewall 131, and the first elongated top plate 141 form a first elongated channel 112 adapted for retaining a first elongated wood member 114 and the elongated bottom plate 120, the second elongated setback sidewall 132, and the second elongated top plate 142 form a second elongated channel 113 adapted for retaining a second elongated wood member 115.

In the first embodiment, a vertical plate 139 interconnects the first elongated setback sidewall 131 and the second elongated setback sidewall 132. The vertical plate 139 includes a notched portion 139*a*. In an illustrative embodiment, a vertical plate 139 is provided approximately every 12 inches. The elongated bottom plate 120, the first elongated setback sidewall 131, the second elongated setback sidewall 132, and two spaced vertical plates 139 define a cavity for receiving mortar 3 during construction of the interior wall. Additionally, a reinforcement bar 8 may be positioned so as to traverse the notched portions 139*a* of spaced vertical plates 139 prior to the addition of mortar 3.

In the first embodiment, a first lower lip 125 is provided along the first side edge 121 of the elongated bottom plate 120 and a second lower lip 126 is provided along the second side edge 122 of the elongated bottom plate 120. A first upper lip 145 is provided along an outer edge of the first elongated top plate 141 and a second upper lip 146 is provided along an outer edge of the second elongated top plate 142. A first plurality of teeth 118 protrude into the first elongated channel 112 for retaining the first elongated wood member 114 therein and a second plurality of teeth 119 protrude into the second elongated channel 113 for retaining the second elongated wood member 115 therein.

Figure 9:
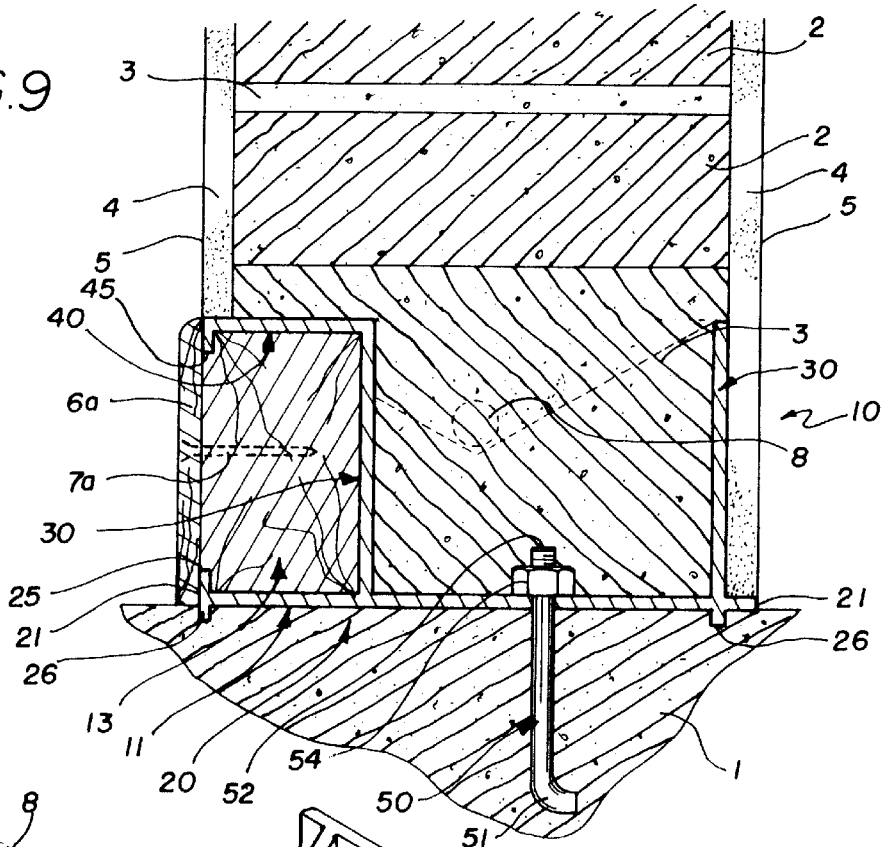
FIG. 9 is a cross sectional view of a second embodiment of the present invention.
Figure 10:
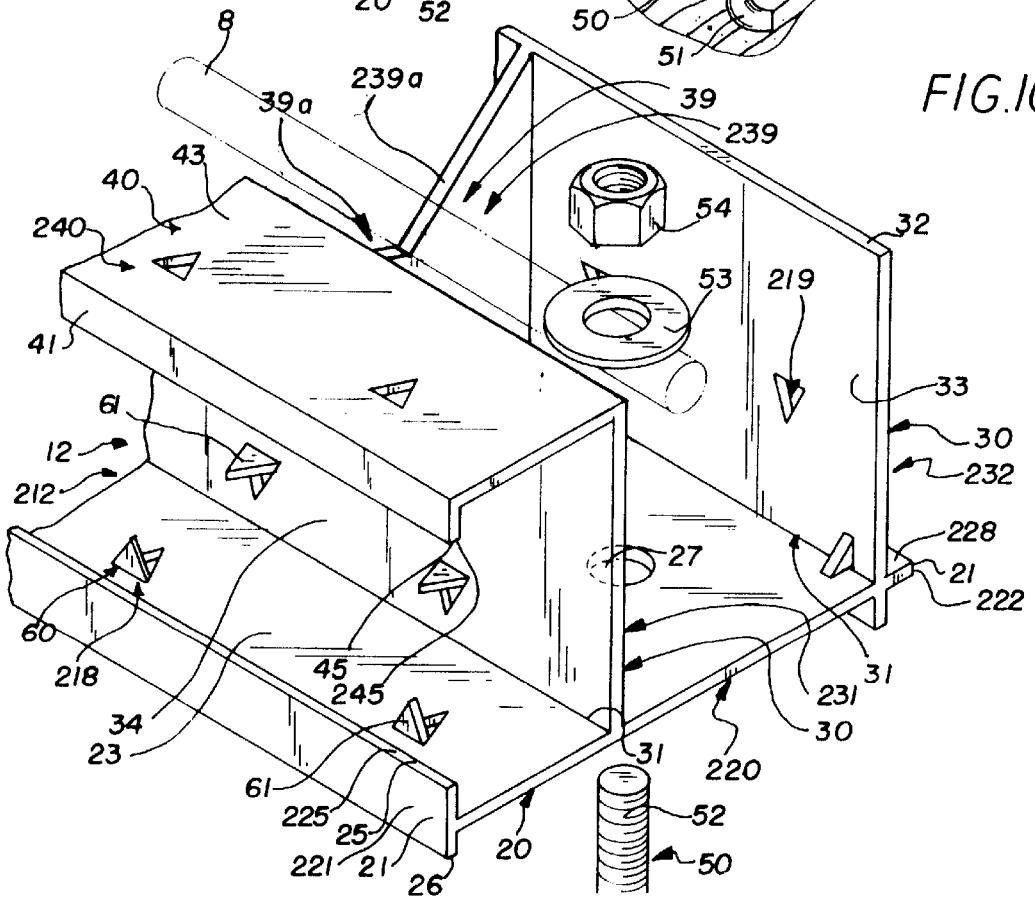
FIG. 10 is a top isometric view of the second embodiment of the present invention.

As best illustrated in FIGS. 9 and 10, it can be shown that a second embodiment of the present invention is intended for use in exterior wall construction wherein the elongated bottom plate 220 has a first side edge 221 and a second side edge 222. A first elongated setback sidewall 231 extends upward from the elongated bottom plate 220 and is setback from the first side edge 221 of the elongated bottom plate 220 and an elongated top plate 240 extends outward from the first elongated setback sidewall 231. As such, the elongated bottom plate 220, the first elongated setback sidewall 231, and the elongated top plate 240 form an elongated channel 212 adapted for retaining an elongated wood member 213. A second elongated setback sidewall 232 extends upward from the elongated bottom plate 220 and is setback from the second side edge 222 of the elongated bottom plate 220.

In the second embodiment, a vertical plate 239 interconnects the first elongated setback sidewall 231 and the second elongated setback sidewall 232. The vertical plate 239 includes a notched portion 239*a*. In an illustrative embodiment, a vertical plate 239 is provided approximately every 12 inches. The elongated bottom plate 220, the first elongated setback sidewall 231, the second elongated setback sidewall 232, and two spaced vertical plates 239 define a cavity for receiving mortar 3 during construction of the exterior wall. Additionally, a reinforcement bar 8 may be positioned so as to traverse the notched portions 239*a* of spaced vertical plates 239 prior to the addition of mortar 3.

In the second embodiment, a lower lip 225 is provided along the first side edge 221 of the elongated bottom plate 220 and an upper lip 245 is provided along an outer edge of the elongated top plate 240. A first plurality of teeth 218 protrude into the elongated channel 212 for retaining the elongated wood member 213 therein. The elongated bottom plate 220 extends beyond the second elongated setback sidewall 232 so as to form a ledge 228. A second plurality of teeth 219 protrude outward from the second elongated setback sidewall 232. The ledge 228 and the second plurality of teeth 219 help retain plaster 4 applied against an outer surface of the second elongated setback sidewall 232 for creating a finished wall surface 5.

In use, an underlying surface, such as a footing 1, is formed and a first end 51 of an anchor bolt 50 is inserted into the footing 1. The elongated base member 11, having the elongated wood member 13 fitted therein, is placed on a bed of mortar 3 such that the foot provided along the side edge 21 of the elongated bottom plate 20 becomes embedded in the bed of mortar 3. The second threaded end 52 of the anchor bolt 50 is inserted through the hole 27 provided in the elongated bottom plate 20 and the threaded nut 54 is used for anchoring the elongated base member 11 to the footing 1. A reinforcement bar 8 may be positioned so as to traverse the notched portions 39*a* of spaced vertical plates 39.

The elongated base member 11 is embedded in mortar 3 and layers of brick 2 are vertically stacked upon each other to create a wall. The notched portion 39*a*allows mortar 3 in adjacent cavities to bond together, thereby forming a continuous bond beam of mortar 3 whereby the reinforcement bar 8 reinforces the continuous bond beam. A layer of plaster 4 is applied to the sides of the stacked bricks to create a finished wall surface 5. The side edge 21 of the elongated bottom plate 20 and the outer edge 41 of the elongated top plate 40 are used as a guide for even application of the plaster 4 (i.e., the side edge and the outer edge are used as a screed). After the plaster 4 has dried, the baseboard 6*a* is easily secured to the elongated wood member 13 by nails 7*a*.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follow:

1. A wall construction system comprising:

an elongated base member comprising:

an elongated bottom plate;

an elongated setback sidewall extending upward from said elongated bottom plate;

an elongated top plate extending outward from said elongated setback sidewall;

said elongated setback sidewall orthogonally oriented relative to said elongated bottom plate and said elongated top plate; and said elongated top plate paralleling said elongated bottom plate in spaced relation, said elongated bottom plate, said elongated setback sidewall, and said elongated top plate forming an elongated channel;

an elongated wood member fitted within said elongated channel for securing of a molding thereto;

said elongated bottom plate has a side edge, an upper surface, and a lower surface;

said elongated setback sidewall has a bottom edge, a top edge, an innermost surface, and an outermost surface;

said elongated top plate has an outer edge, an inner edge, an upper surface, and a lower surface;

said elongated wood member has inner face, an outer face, a top face, and a bottom face;

said elongated wood member fitting within said elongated channel such that said inner face abuts said outermost surface of said elongated setback sidewall, such that said top face abuts said lower surface of said elongated top plate, and such that said bottom face abuts said upper surface of said elongated bottom plate;

said elongated bottom plate includes a lower lip along said side edge thereof;

said lower lip extending upward from said upper surface of said elongated bottom plate;

said elongated top plate includes an upper lip along said outer edge thereof;

said upper lip extending downward from said lower surface of said elongated top plate;

said outer face of said elongated wood member has an upper groove therein adjacent said top face and has a lower groove therein adjacent said bottom face;

said lower groove receiving said lower lip of said elongated bottom plate; and said upper groove receiving said upper lip of said elongated top plate.

2. The wall construction system of claim 1, wherein said elongated bottom plate has a hole therein for receiving an anchor bolt for anchoring said elongated base member to an underlying surface.

3. The wall construction system of claim 1, wherein said elongated base member further comprises:

a second elongated top plate extending outward from said second elongated setback sidewall;

said second elongated setback sidewall orthogonally oriented relative to said elongated bottom plate and said second elongated top plate, said second elongated top plate paralleling said elongated bottom plate in spaced relation;

said elongated bottom plate, said second elongated setback sidewall, and said second elongated top plate forming a second elongated channel; and a second elongated wood member fitted within said second elongated channel for securing of a second molding thereto.

4. The wall construction system of claim 3, wherein: p1 said elongated bottom plate further includes a second lower lip along said second side edge thereof; and said second elongated top plate further includes an outer edge, and a second upper lip along said outer edge.

5. The wall construction system of claim 3, further comprising a second plurality of teeth protruding into said second elongated channel and into said second elongated wood member retaining said second elongated wood member within said second elongated channel.

6. A wall construction system comprising:

an elongated base member comprising:

an elongated bottom plate;

an elongated setback sidewall extending upward from said elongated bottom plate;

an elongated top plate extending outward from said elongated setback sidewall;

said elongated setback sidewall orthogonally oriented relative to said elongated bottom plate and said elongated top plate; and said elongated top plate paralleling said elongated bottom plate in spaced relation, said elongated bottom plate, said elongated setback sidewall, and said elongated top plate forming an elongated channel;

an elongated wood member fitted within said elongated channel for securing of a molding thereto;

said elongated bottom plate has a side edge, an upper surface, and a lower surface;

said elongated setback sidewall has a bottom edge, a top edge, an innermost surface, and an outermost surface;

said elongated top plate has an outer edge, an inner edge, an upper surface, and a lower surface;

said elongated wood member has inner face, an outer face, a top face, and a bottom face;

said elongated wood member fitting within said elongated channel such that said inner face abuts said outermost surface of said elongated setback sidewall, such that said top face abuts said lower surface of said elongated top plate, and such that said bottom face abuts said upper surface of said elongated bottom plate;

said elongated bottom plate includes a foot along said side edge thereof; and said foot extending downward from said lower surface of said elongated bottom plate.

7. The wall construction system of claim 6, further comprising:

a wood member retaining means retaining said elongated wood member within said elongated channel said wood member retaining means comprising a plurality of teeth protruding into said elongated channel and into said elongated wood member from at least one of said elongated bottom plate, said elongated setback sidewall, and said elongated top plate.

8. The wall construction system of claim 6, wherein said elongated bottom plate has a hole therein for receiving an anchor bolt for anchoring said elongated base member to an underlying surface.

9. A wall construction system comprising:

an elongated base member comprising:

an elongated bottom plate;

a first elongated setback sidewall extending upward from said elongated bottom plate;

an elongated top plate extending outward from said first elongated setback sidewall;

said first elongated setback sidewall orthogonally oriented relative to said elongated bottom plate and said elongated top plate; and said elongated top plate paralleling said elongated bottom plate in spaced relation, said elongated bottom plate, said first elongated setback sidewall, and said elongated top plate forming an elongated channel;

an elongated wood member fitted within said elongated channel for securing of a molding thereto;

said elongated bottom plate having a first side edge, a second side edge opposite said first side edge, an upper surface, and a lower surface;

said first elongated setback sidewall having a bottom edge, a top edge, an innermost surface, and an outermost surface;

said elongated top plate having an outer edge, an inner edge, an upper surface, and a lower surface;

said elongated wood member having inner face, an outer face, a top face, and a bottom face;

said elongated wood member fitting within said elongated channel such that said inner face abuts said outermost surface of said first elongated setback sidewall, such that said top face abuts said lower surface of said elongated top plate, and such that said bottom face abuts said upper surface of said elongated bottom plate;

said elongated bottom plate including a foot along said side edge thereof; and said foot extending downward from said lower surface of said elongated bottom plate;

a second elongated setback sidewall extending upward from said elongated bottom plate and being setback from said second side edge of said elongated bottom plate such that said second elongated setback sidewall is positioned substantially parallel to and in spaced relationship from said first elongated setback sidewall, said second side edge being opposite said first side edge, said second elongated setback sidewall orthogonally oriented relative to said elongated bottom plate.

10. The wall construction system of claim 9, further comprising:

a vertical plate interconnecting said first enlongated setback sidewall and said second enlongated sidewall.

11. The wall construction system of claim 9, wherein:

said elongated bottom plate includes a first lower lip along said first side edge thereof; and wherein said first enlongated top plate has a outer edge, said first enlongted top plate including a first upper lip along said outer edge thereof.

12. The wall construction system of claim 9, wherein said elongated bottom plate extends beyond said second elongated setback sidewall so as to form a ledge.

13. The wall construction system of claim 9, further comprising:

a plurality of teeth protruding outward from said second elongated setback sidewall.

* * * * *